US005941120A

United States Patent [19]

Jee

[11] Patent Number: 5,941,120

[45] Date of Patent: Aug. 24, 1999

[54] PLIERS FOR COMPRESSION CONNECTING AN END CONNECTOR

[75] Inventor: Beam-Chi Jee, Taipei Hsien, Taiwan

[73] Assignee: Hanlong Industrial Co., Ltd., Taipei Hsien, Taiwan

[21] Appl. No.: 09/081,057

[22] Filed: May 19, 1998

[51] Int. Cl.[6] ..... H01R 43/042

[52] U.S. Cl. ..... 72/409.14; 29/751; 29/282

[58] Field of Search ..... 29/237, 234, 751, 29/282, 270; 72/409.14, 409.19, 409.01

[56] References Cited

U.S. PATENT DOCUMENTS

| | | | |
|---|---|---|---|
| 2,333,120 | 11/1943 | Parker | 29/237 |
| 3,630,068 | 12/1971 | Floyd | 29/751 |
| 4,785,517 | 11/1988 | Takano | 29/237 |
| 4,811,441 | 3/1989 | Potesta | 29/237 |
| 5,040,288 | 8/1991 | Nilsson | 29/751 |
| 5,392,508 | 2/1995 | Holliday | 29/751 |
| 5,596,800 | 1/1997 | Holliday | 29/751 |
| 5,647,119 | 7/1997 | Bourbeau | 29/751 |

FOREIGN PATENT DOCUMENTS

| | | | |
|---|---|---|---|
| 2429180 | 1/1975 | Germany | 29/237 |

*Primary Examiner*—Daniel C. Crane

*Attorney, Agent, or Firm*—Bacon & Thomas, PLLC

[57] ABSTRACT

A pair of pliers for connecting an end connector by compression, wherein, a main handle is provided on the front end thereof with a mould block which is provided on the front end thereof with an alignment notch, a clamping seat is provided behind the notch and is clamped by an elastic element, a secondary handle is pivotally connected in the middle of the main handle, a pusher block is pivotally connected to the secondary handle and is provided on a front end thereof with an end-connector socket, after closing by pressing of the main handle to the secondary handle, the pusher block pushes the end connector to compress a tapered pipe; after combination of the end connector with a signal line by insertion, the signal line is placed in the clamping seat, and the end connector is inserted in the socket, when the main handle and the secondary handle are closed by pressing to each other, a collar can be abutted on the inner side of the clamping seat, so that the end connector and the collar can be compressed to tightly combine with the signal line.

2 Claims, 4 Drawing Sheets

PLIERS FOR COMPRESSION CONNECTING AN END CONNECTOR

BACKGROUND OF THE INVENTION

1. Field of the Invention

The present invention relates to a pair of pliers for connecting an end connector by compression, and especially to a pair of pliers for effectively and tightly compression connecting an end connector integrately with signal lines in a simple and fast way.

2. Description of the Prior Art

Signal lines are mostly combined in assembling with a television by using of end connectors, while connections of the end connectors with the signal lines are fixed with collars.

There are two kind of structures using collars in connections of end connectors with signal lines in the markets presently, one of them allows collars to be clamped and deformed for combining end connectors with signal lines, the way of fixing is, to move away the insulation layers of signal lines in the first place to put the interior signal lines together with an end connector, then to slip a collar with larger diameter over the junction of the end connector and the signal lines, and then compress the collar to flatten it with a pair of pliers, so that the collar tightly presses the end connector and the signal lines, and thus an object of combining can be achieved. However, although the stated connection of the end connector and the signal lines can get the object of combining, it can not make a complete sealing among the collar and the signal lines, it is subjected to water leakage, quality of transmision is very low, and during the process of combining of the end connector and the signal lines, the collar has to be moved accurately to the junction of the end connector and the signal lines, this is rather troublesome, and the rate of failure of this is high, besides, the force flatening the collar shall be completely under control, too large force may damage the insulation layers of the signal lines, while too light force may render the end connector to drop from the signal lines.

Another kind of the structures using a collar in connection is shown in FIG. 1 and 2, wherein, the collar 21 is provided on the front end thereof with a tapered pipe 22, when a signal line 10 is extended through the collar 21 and is inserted into an end connector 20, a pair of pliers is used to move the collar 21 toward the end connector 20, so that the tapered pipe 22 is inserted into the end connector 20 to press the signal line 10 to make a comnination as shown in FIG. 2, such a combination structure can get rid of the defect resided in the conventional combination structure for the end connector and the signal lines, however, the way of combination therein can not make positioning by a pair of common pliers once for all, the end connector must be compressed in various directions in order not to make angular deviation of the collar which in turn will reduce the effect of combination, the disadvantage of the earlier way of connection between the end connector and a collar can be improved by the structure, but it is time consuming.

A specific improved pair of pliers for combining the structure of an end connector and signal lines by compression is desired to be designed to largely increase the effect of the combination of the end connector with the signal lines by compressing the collar toward the end connector in all directions once for all during the process of compressiong connecting.

SUMMARY OF THE INVENTION

The primary object of the present invention therefore is to provide a pair of pliers for connecting an end connector with signal lines by compression, it is characterized in that, a mould block is provided in the front of a main handle, the mould block is provided with an alignment notch, and is provided with an elastic element for clamping a pair of clamping members composing a clamping seat which is in alignment with the notch, and a secondary handle is pivotally connected to the middle of the main handle, the secondary handle is provided on the end thereof with a pusher block of which the front end is provided with a socket for pushing the end connector to compress a tapered pipe after closing by pressing of the main handle to the secondary handle; and after combination of the end connector with the signal lines by insertion, the signal lines are placed in the clamping seat, and the end connector is inserted in the socket, when the main handle and the secondary handle are closed by pressing to each other, the inner end of the end connector having the collar thereon can be abutted on the inner side of the clamping seat, so that the end connector and the collar can be compressed to tightly combined with the signal lines, during combination of the end connector and the collar, compression force is coming from every direction, so that the collar can be pressed once for all to its proper position, and operation of this thus is fast and simple.

The present invention will be apparent in its practical structure and objects after reading the detailed description of the preferred embodiment thereof in reference to the accompanying drawings

DETAILED DESCRIPTION OF THE PREFERRED EMBODIMENT

Figure 1:
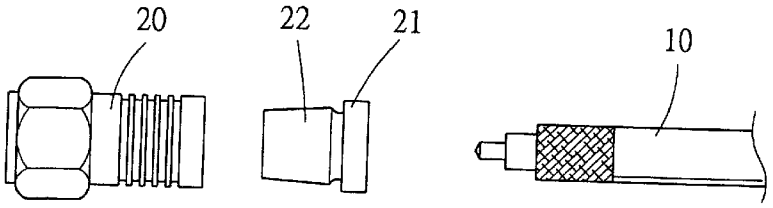
Fig. 1 PRIOR ART
FIG. 1 is a schematic view showing the situation before connection of an end connector and a signal line commonly used.
Figure 2:
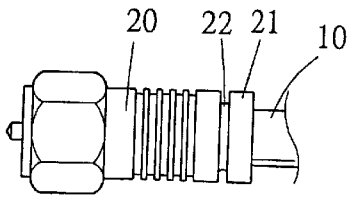
Fig. 2 PRIOR ART
FIG. 2 is a schematic view showing the situation after connection of the end connector and the signal line commonly used.
Figure 3:
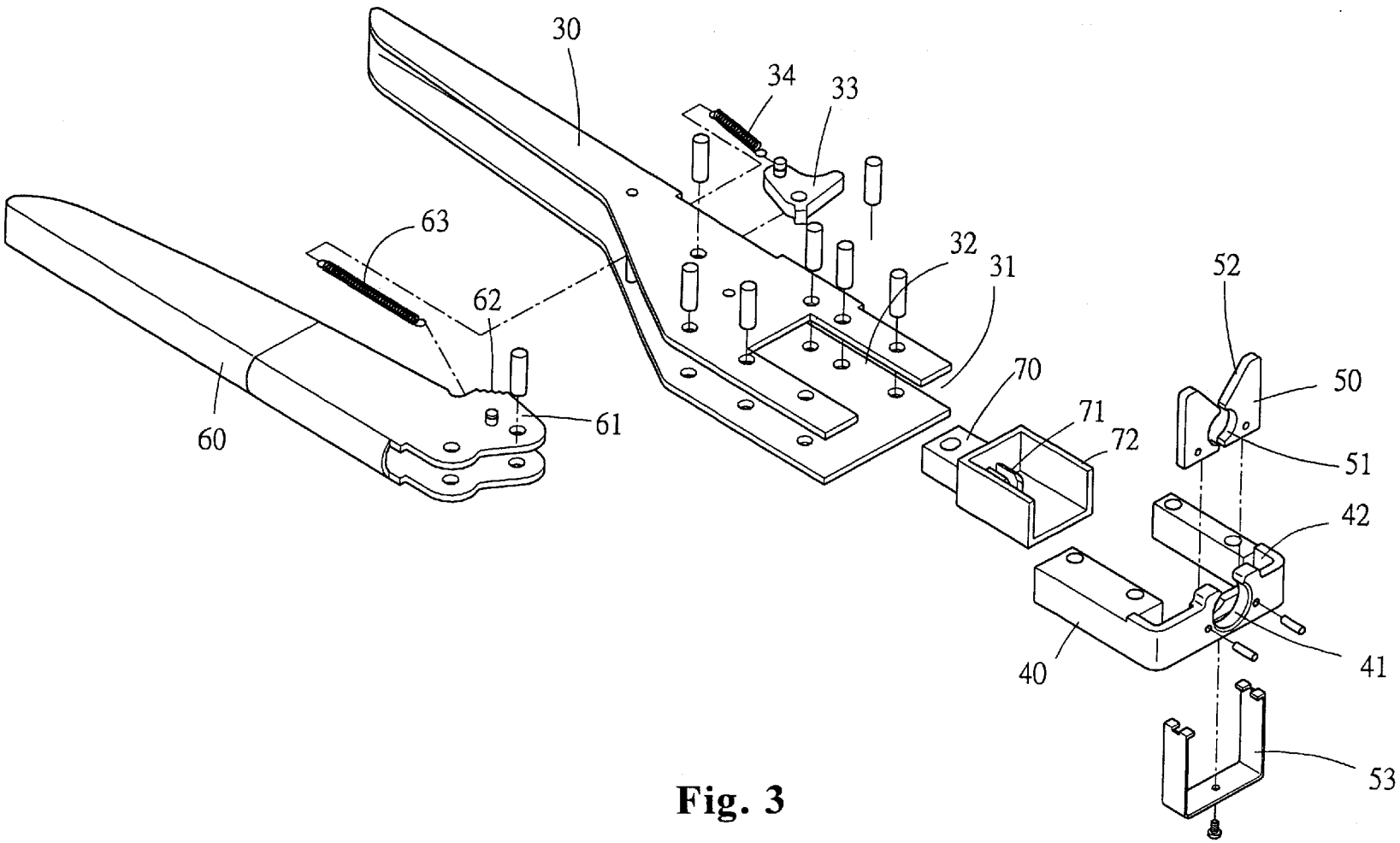
FIG. 3 is an analytical perspective view of the present invention.
Figure 4:
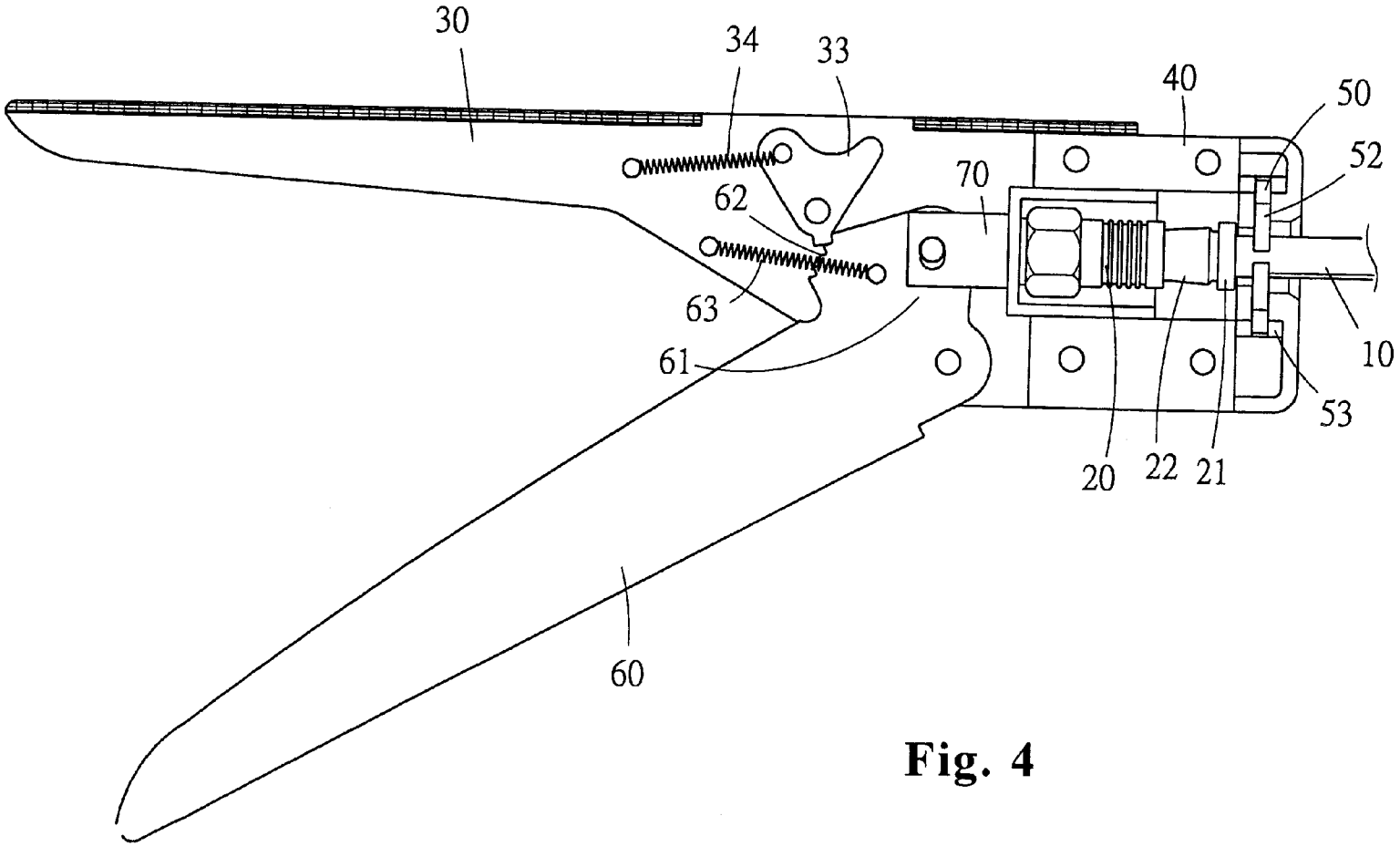
FIG. 4 is a schematic view showing the situation before compression connection of an end connector and a signal line in the present invention.
Figure 5:
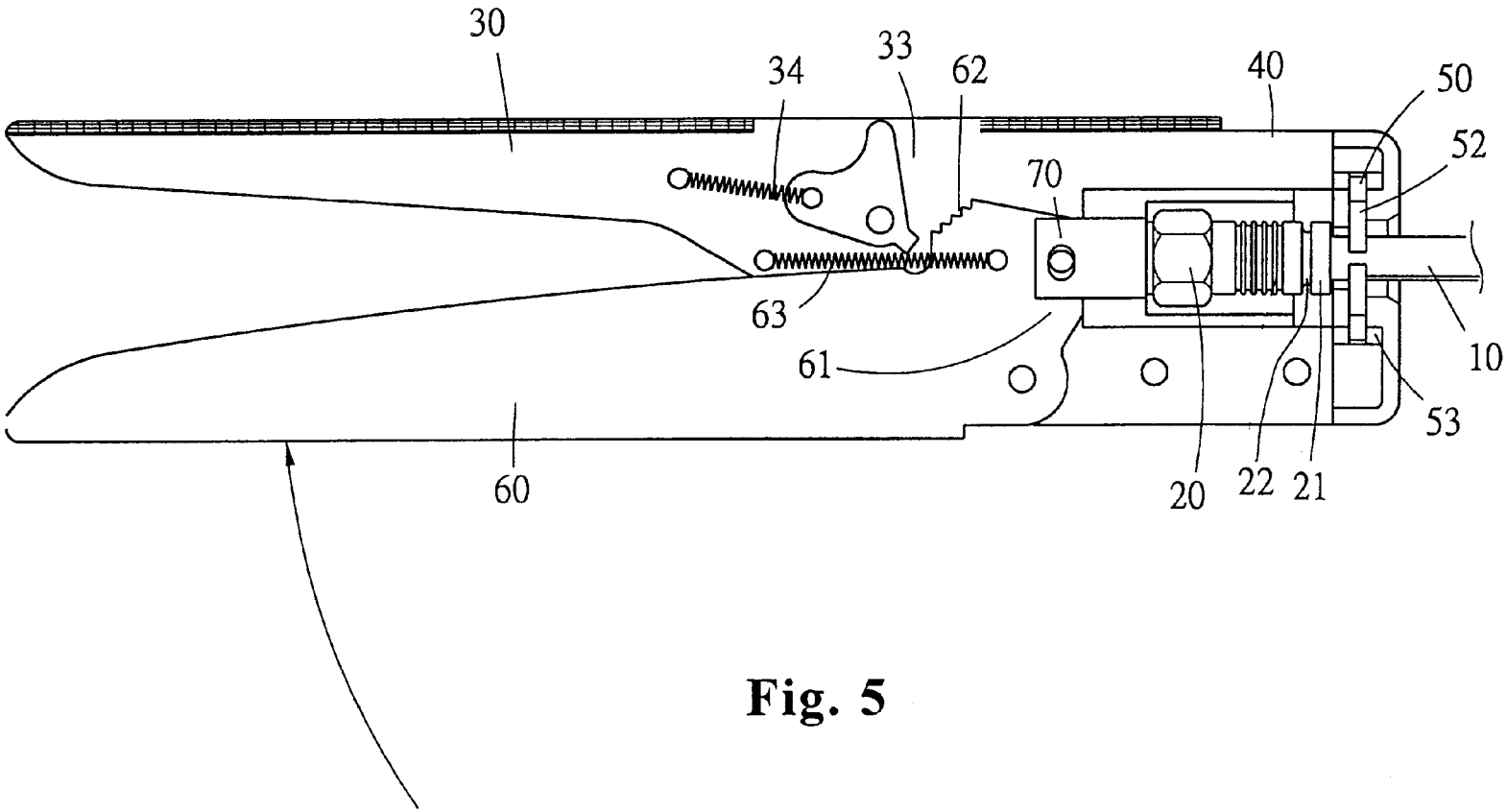
FIG. 5 is a schematic view showing the situation after compression connection of the end connector and the signal line in the present invention.

Referring to FIG. 3, the end connector of the present invention is comprised of:

- a main handle 30 which is provided on the front end thereof with a hollow receiving chamber 31 of which the front portion is used as a slide way 32, the main handle 30 is pivotally provided therein with a tenon 33 which is connected at one end thereof to the base portion of the main handle 30 via a spring 34;
- a mould block 40 which is locked in the receiving chamber 31 and is symetrically disposed relative to both sides of the slide way 32, the mould block 40 is provided on the front end thereof with an alignment notch 41 which is provided in the rear of it with a groove 42 for a clamping seat 50;
- a pair of clamping members composing the clamping seat 50 are pivotally provided in the groove 42, a clamping hole 51 is formed in the middle of the clamping seat 50, the clamping hole 51 is provided thereabove a guiding portion 52, and an elastic element 53 is provided to clamp both sides of the clamping seat 50, so that the clamping seat 50 is endued with an elastic compressive force;

a secondary handle 60 which is pivotally connected to the rear end of the receiving chamber 31, the secondary handle 60 is provided with a pivotal connection portion 61, when the secondary handle 60 is moved relative to the main handle 30, the pivotal connection portion 61 can move forwardly and rearwardly, a line of positioning teeth 62 are provided on one side of the pivotal connection portion 61 for the tenon 33, the other side of the pivotal connection portion 61 is connected on one end thereof to the main handle 30 via a spring 63, so that the main handle 30 and the secondary handle 60 can be kept nearly closed normally;

a pusher block 70 is pivotally connected to the pivotal connection portion 61 on the front end of the secondary handle 60, and is provided on the front end thereof with an end-connector socket 71 which is provided on each side thereof with a guiding plate 72 which slides in the above mentioned slide way 32, As shown in FIG. 4, by means of the above stated members after assembling, the main handle 30 and the secondary handle 60 are departed from each other, the pusher block 70 is retracted to the innermost position thereof, now an end connector 20 and a signal line 10 are combined by insertion and are slipped over with a collar 21 and are inserted into the socket 71, and the signal line 10 is placed on the guiding portion 52 of the clamping seat 50 and force is exerted thereon to move away the pair of clamping members of the clamping seat 50 to allow the signal line 10 to be held in the clamping hole 51, and then the main handle 30 and the secondary handle 60 are closed by pressing to each other (as shown in FIG. 5), the pusher block 70 thus is moved forwardly, and the collar 21 is abutted on the inner side of the clamping seat 50 by the pushing force to make insertion of a tapered pipe 22 into the end connector 20, and the end connector 20 and the signal line 10 are tightly and integrately combined.

When in operation of the pliers for connecting an end connector by compression, the clamping seat 50 does positioning of the signal line 10 and provides a supporting surface for the collar 21, when the pusher block 70 is moved forwardly by closing of the secondary handle 60 to push the tapered pipe 22 into the end connector 20 once for all. In this way, the present invention not only completes combination of the end connector 20 with the signal line 10 very fast, but also can get better quality of combination.

In view of the above description, the structure of the present invention has never existed in the markets, and it can improve the conventional compression connecting technique for an end connector with a signal line. Having thus described the invention with improveness and novelty, what I claim as new and desire to be secured by Letters Patent of the United States are:

1. A pair of pliers for connecting an end connector by compression, said pliers comprising:

a main handle having a front end on which a hollow receiving chamber is provided, said receiving chamber having two sides which form a slide way;

a mould block secured in said receiving chamber and positioned symmetrically relative to said sides of said slide way;

an alignment notch formed at a front end of said mould block, said notch having a groove provided on a rear side thereof;

a clamping seat formed by a pair of clamping members which are pivotally disposed in said groove, said clamping seat having a clamping hole formed in a middle thereof;

an elastic element arranged to clamp both of said clamping members such that said clamping members are biased with an elastic compressive force;

a secondary handle having a pivotal connection portion which is connected to said main handle by a spring, said secondary handle also being pivotally connected to said main handle on a rear end of said receiving chamber such that a movement of said secondary handle relative to said main handle moves said pivotal connection portion forwardly and rearwardly;

a pusher block pivotally connected to said pivotal connection portion of said secondary handle; and an end-connector socket provided on a front end of said pusher block, said end-connector socket having guide plates arranged on opposite sides thereof to slide in said slide way;

wherein movement of said secondary handle towards said main handle causes said pivotal connection portion to move forwardly to compress an end connector and collar disposed in said end-connector socket with said collar abutting a rear side of said clamping seat such that a tapered pipe of said collar is inserted into said end connector to integrally combine said end connector and collar.

2. A pair of pliers according to claim 1, wherein said clamping seat has a guiding portion above said clamping hole, said guiding portion being arranged such that a signal line in contact with said guiding portion forces said clamping members apart to allow the signal line to enter and be held in said clamping hole.

* * * * *